US006574815B2

(12) United States Patent
Freeman et al.

(10) Patent No.: US 6,574,815 B2
(45) Date of Patent: Jun. 10, 2003

(54) PILLOWTOP/PANEL ATTACHMENT GUSSET WITH RUFFLED CORNERS

(75) Inventors: William Freeman, Highpoint, NC (US); Robert Wagner, Forth Atkinson, WI (US); Gerald J. Sproesser, Albany, NY (US)

(73) Assignee: Sealy Technology LLC, Trinity, NC (US)

( * ) Notice: Subject to any disclaimer, the term of this patent is extended or adjusted under 35 U.S.C. 154(b) by 27 days.

(21) Appl. No.: 09/978,645

(22) Filed: Oct. 16, 2001

(65) Prior Publication Data

US 2002/0144352 A1 Oct. 10, 2002

Related U.S. Application Data

(63) Continuation of application No. 09/829,698, filed on Apr. 10, 2001.

(51) Int. Cl.[7] ..... A47C 27/00

(52) U.S. Cl. ..... 5/716; 5/717; 5/737; 5/739; 5/690

(58) Field of Search ..... 5/690, 696, 716, 5/717, 721, 737, 739; 29/91, 91.1, 91.6

(56) References Cited

U.S. PATENT DOCUMENTS

| | | | | |
|---|---|---|---|---|
| 4,424,600 A | | 1/1984 | Callaway | |
| 4,463,466 A | * | 8/1984 | May et al. | 5/721 |
| 5,428,852 A | | 7/1995 | Tenuta et al. | |
| 5,475,881 A | * | 12/1995 | Higgins et al. | 5/737 |
| 5,542,775 A | | 8/1996 | Bechtoldt et al. | |
| 5,586,511 A | * | 12/1996 | Porter et al. | 112/2.1 |
| 5,655,241 A | | 8/1997 | Higgins et al. | |
| 5,701,623 A | | 12/1997 | May | |
| 5,974,609 A | | 11/1999 | Nunez et al. | |
| 6,088,858 A | * | 7/2000 | Juster et al. | 5/737 |
| 6,125,488 A | | 10/2000 | Vogland et al. | |
| 6,293,213 B1 | * | 9/2001 | Block et al. | 112/470.05 |

FOREIGN PATENT DOCUMENTS

| | | |
|---|---|---|
| GB | 1233945 | 6/1971 |

OTHER PUBLICATIONS

International Search Report.

* cited by examiner

*Primary Examiner*—Michael F. Trettel
(74) *Attorney, Agent, or Firm*—Arter & Hadden LLP

(57) ABSTRACT

An attachment gusset with ruffled corners and method and machinery for manufacture provides a gusset formed of a continuous strip of material which is pleated at corners or turns in direction of the gusset to form ruffles which are attached to an adjacent layer of material. The ruffled gusset lies substantially flat against adjacent layers of material to which it is attached in a pressed state, and can be expanded to accommodate dimensional structures, such as cushioned pads. The number and spacing of pleats can be adjusted according to the radius of the corners or turns in the gusset. In a method of construction of the gusset, the pleats are formed as the material to which the gusset is attached is turned relative to the sewing point of attachment.

30 Claims, 6 Drawing Sheets

PILLOWTOP/PANEL ATTACHMENT GUSSET WITH RUFFLED CORNERS

RELATED APPLICATIONS

This application is a continuation of U.S. application Ser. No. 09/829,698, filed Apr. 10, 2001, still pending.

FIELD OF THE INVENTION

The present invention pertains generally to sewn articles and sewing operations and, more particularly, to sewn attachment of different pieces or panels of material by gussets.

BACKGROUND OF THE INVENTION

In the sewn construction of padded articles, such as furniture cushions, seating and mattresses, a padded layer or layers may be enclosed in upholstery and attached by a gusset to an accompanying pad or spring unit. As shown in FIGS. 7 and 8, for example in a pillowtop style mattress, a pad or pillowtop 100 is attached to an adjacent support structure 120 by a gusset 140, which in one form is a folded band of material sewn along the fold line 141 and one edge 142 to a first panel 110, and sewn along the other edge 143 to the underside of pillowtop 100. At corners 160 of the pad 100 to which the gusset 140 is sewn, the gusset is mitered at seam 170 to allow the gusset to turn the ninety degree corner of the support structure 120. The mitering of the gusset at the corners 160 requires at least one miter cut to be made in the gusset at each right angle corner of the adjoining panel. Each of the mitered corner cuts must be individually sewn so that the gusset forms a closed structure between the mattress and the pillowtop. In a manual assembly process, the gusset is separately constructed by sewing together each leg of the gusset at the mitered corners to form a gusset frame which matches the mattress panel. The gusset is then sewn-attached to the edges of the top panel of the mattress by a tape edge. Thereafter, the pillowtop is attached to the other free edge of the gusset by a second tape edge.

If the miter cuts at the corners of the gusset are not made at the correct angles, the gusset corner will not have a smooth contour or appearance. Also, in articles where the gusset remains visible, the multiple seams in the gusset are unsightly and vulnerable to separation. Constructing a gusset this way is a tedious manual production process which adds significantly to the cost of producing pillowtop mattresses and similar sewn articles.

SUMMARY OF THE INVENTION

The present invention overcomes these and other disadvantages of the prior art by providing a ruffled gusset corner construction which is easier to manufacture and which has an improved finished appearance and strength over prior art pillowtop attachment constructions. In accordance with one aspect of the invention, there is provided an attachment gusset for attachment of adjoining panels, wherein the gusset is continuously folded in half along a length of the material and sewn at the fold line to a first panel, generally along one or more sides of the panel. At the corners of the panel, a series of pleats are formed on the inside folded edge of the gusset to create a ruffled ninety degree corner, or a turn of fewer or greater degrees, which matches the edge of the panel. In an automated method of manufacture aspect of the invention, the panel is turned ninety degrees relative to a sewing machine head as the pleats are formed and sewn to the panel at the corner. The aligned edges of the gusset are aligned with the edge of a first panel to which the gusset is sewn. The edge of the gusset against the panel is sewn with the panel edge by a tape edge. The other edge of the gusset is attached to the edge of a second overlying or parallel panel by another tape edge. Edges of other layers of material may also be included in the tape edge. In this way, two panels are securely attached about the perimeter. The spreading of the gusset halves relative to the sewn fold allows it to accommodate layers of padding contained by the panels, such as a padded pillowtop attached to the top panel of a mattress.

These and other aspects of the invention are herein described with reference to the accompanying Figures.

DETAILED DESCRIPTION OF PREFERRED AND ALTERNATE EMBODIMENTS

The following describes preferred and alternate embodiments of a continuous attachment gusset with ruffled bends or corners, and methods and machinery for automated manufacture of such gussets.

Continuous Attachment Gusset with Ruffled Bends or Corners

Figure 1:
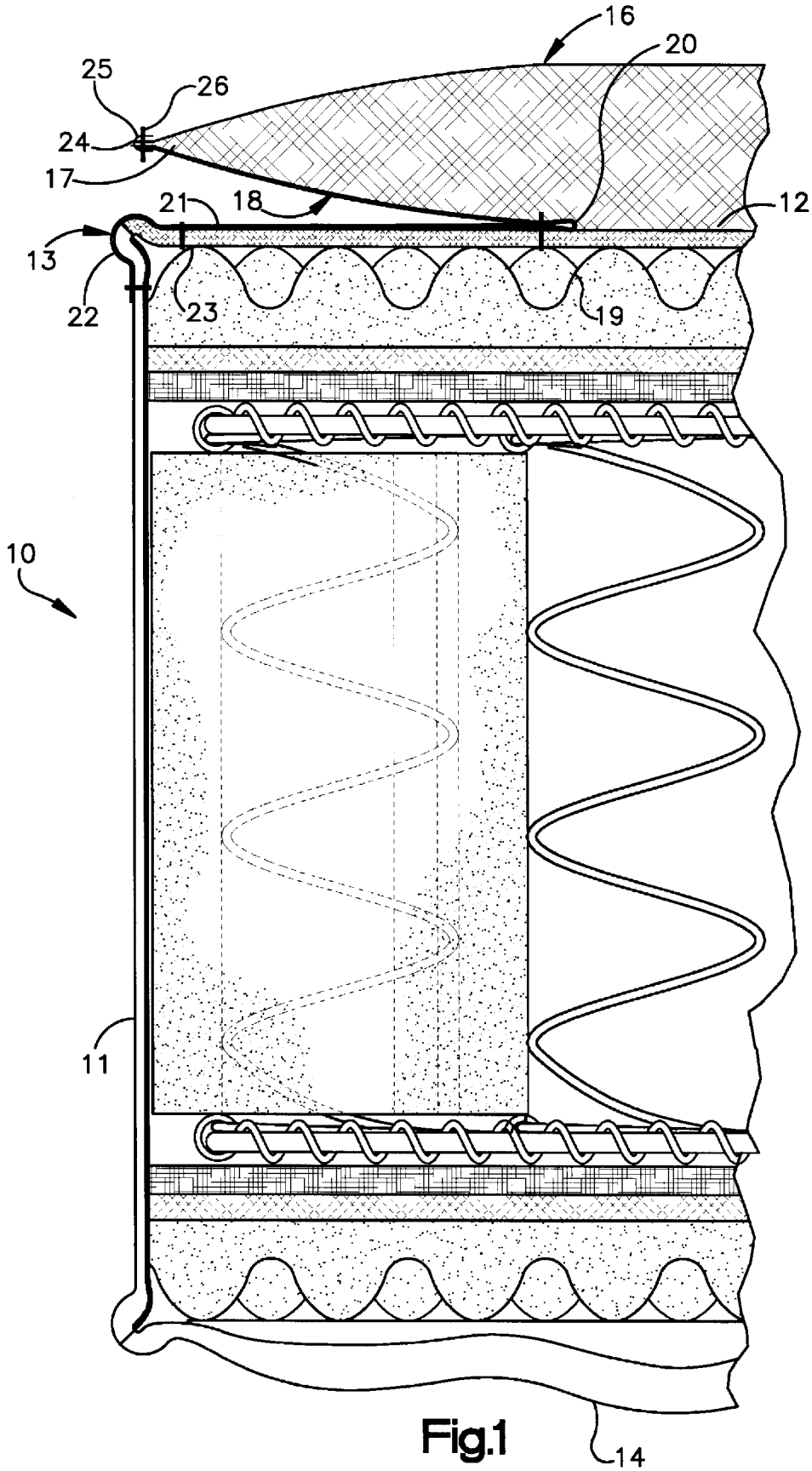
FIG. 1 is a cross-sectional view of a mattress constructed according to the present invention.

In FIG. 1 there is shown a mattress 10 with covering material 11 encapsulating an innerspring construction or assembly as is generally known in the art. The major parallel and opposed sides of the mattress are covered by respective panels 12 and 14. The panels may include multiple layers, such as an internal layer directly overlying the innerspring, and an upholstered exterior layer, which is commonly quilted. The so-called "pillowtop" style mattress further includes a separately encapsulated padding layer or pillowtop 16 which covers one or both panels. Different ways of attaching the pillowtop 16 to the mattress have been devised, with the most common construction being sewn attachment about the perimeter of each panel. Because the pillowtop has a substantial thickness dimension, e.g. several inches in cross-section, attachment to the panels 12, 14 at the perimeter requires a gusset 18 which reaches from the panel perimeter 13 to the tapered edge 17 of the pillowtop 16. The gusset 18 is made in the form a strip of material, e.g., mattress upholstery material, which is folded in half along the length, and sewn by stitches 19 proximate to the fold 20 to the panel 12 or 14. The gusset 18 thus has two 21 and 24 opposed to fold 20, which are generally aligned with edge or perimeter 13 of panels 12, 14. Edge 21 of the gusset is attached to perimeter 13 by a tape 22 secured by stitches 23. Edge 24 of the gusset is attached by a tape 25 secured by stitches 26 to the perimeter or edge 17 of the pillowtop 16. This basic construction of sewn attachment of a pillowtop to a mattress panel is utilized in the present invention. However, the invention is applicable to other types of gusset attachment, for example wherein the free edges of the gusset opposite the fold are sewn directly to the panel or pillowtop upholstery and not covered by a tape edge, or wherein the edges of the gusset are hemmed and sewn-attached.

Figure 2:
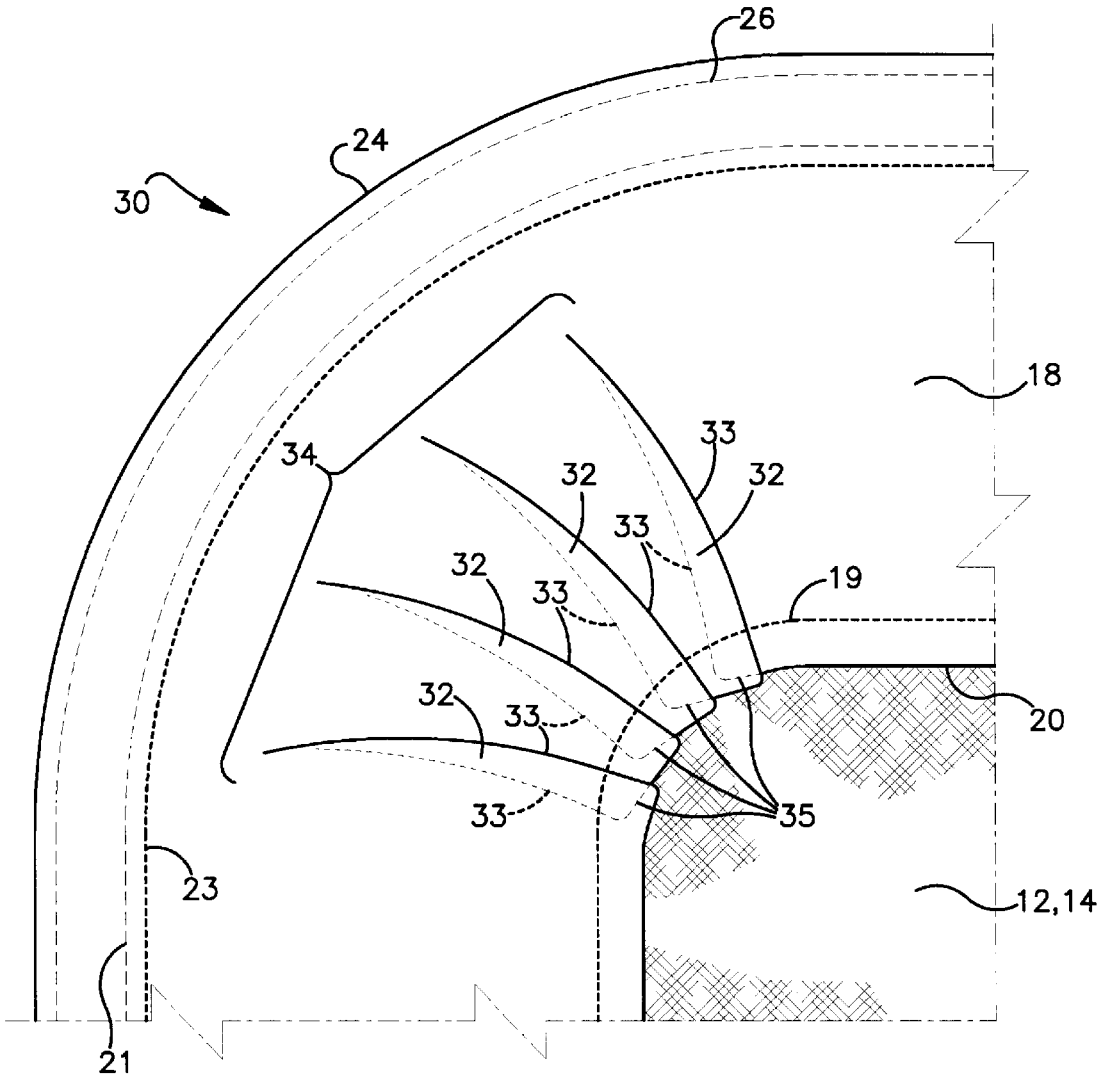
FIG. 2 is a top view of a portion of a ruffled gusset constructed according to the present invention.

As shown in FIG. 2, the corners 30 of the gusset 18 are formed as a radial bend, which matches the curvature of the underlying panel, which in this case is a ninety degree turn, although the invention is applicable to any degree turn which may be required to attach a gusset to a panel. To form the radial bend, one or more pleats 32 are formed in the gusset at the fold 20 and secured to the panel 12 or 14 by stitches 19. Each pleat 32 has a folded base end 35 of variable length, and upper and lower pleat folds 33 which extend across a width of the gusset material from gusset fold 20 toward gusset edges 21, 24. When formed in series about the radiused corner, the pleats 32 are collectively referred to as a ruffle 34, or ruffled corner 34. The ruffled corner 34 avoids having to make a mitered seam, whereby the gusset 18 remains a continuous band of material around each curve or corner of a panel. This gusset construction is suited for automated attachment of the gusset to a panel about an entire perimeter of the panel, and eliminates the step of having to pre-manufacture the gusset before attachment, as further described herein.

The invention thus provides a gusset wherein turns, curves or corners of the gusset are ruffled by one or more pleats formed in one edge of the gusset material. The pleats are sewn in place to an underlying panel, and an opposite edge of the gusset is also sewn to a panel. In the pillowtop example, one of the opposite edges of the gusset (e.g., edge 21, opposite to fold 20) is sewn to the perimeter of the mattress panel 12, 14 by stitches 23 through tape 22. The other edge 24 (opposite to fold 20) is sewn to the pillowtop edge 17 by stitches 26 through tape 25. Other attachment arrangements are within the conceptual scope of the invention, in which pleats are formed on one side of the gusset to provide a continuous gusset with changes in direction according to the number, size and spacing of the pleats 32 and the resulting gusset 34.

Method and Machinery for Automated Manufacture of Gussets with Ruffled Bends or Corners In accordance with another general aspect of the invention, there is provided a method and machinery for automated production of ruffled gussets of the type described herein. When the gusset 18 is attached to a panel, e.g. 12 or 14, the gusset, which may or may not be folded along the length of the material, it is accordingly laid out over or proximate to the panel, and attached by a continuous or periodic stitch line through the two layers of material. Where there is a curve or corner in the panel (or where there is to be a curve or corner in the gusset independent of the configuration or perimeter of the panel—as in the case where a gusset does not follow a perimeter of the panel) the panel is turned relative to the point of attachment of the gusset (i.e., the sewing needle) to alter the direction of the continuous band of gusset material. The pleats 32 are formed in one side of the gusset 18 as the panel is turned relative to the present point of attachment, i.e., the sewing needle or adhesive dispensing point. This is referred to generally as the "attachment point". Preferably, the pleats 32 are formed just prior to reaching the attachment point. The pleats can be formed entirely by hand, or by use of a manual tool such as blade or paddle or any other suitable instrument, such as a flat strip or batten. Alternatively, the pleats 32 may be formed and held in place by tape or adhesive, and then run through a sewing machine to install stitches 19. This can be done apart from or simultaneously with the turning of the panel. In certain applications, adhesive alone may be used to attach the gusset to an adjacent piece of material.

A machine system for automated manufacture of the described attachment gusset is illustrated schematically in FIGS. 3–6. A spool 60 of gusset material is rotationally mounted above a folder 62 which includes bilateral guides 64 and a centerline folding blade therebetween to place the gusset material 18 in a folded state along a length of the material downstream of the folder 62. In this particular embodiment, the gusset material is folded in half along the length, although other folding arrangements could be utilized.

Figure 3:
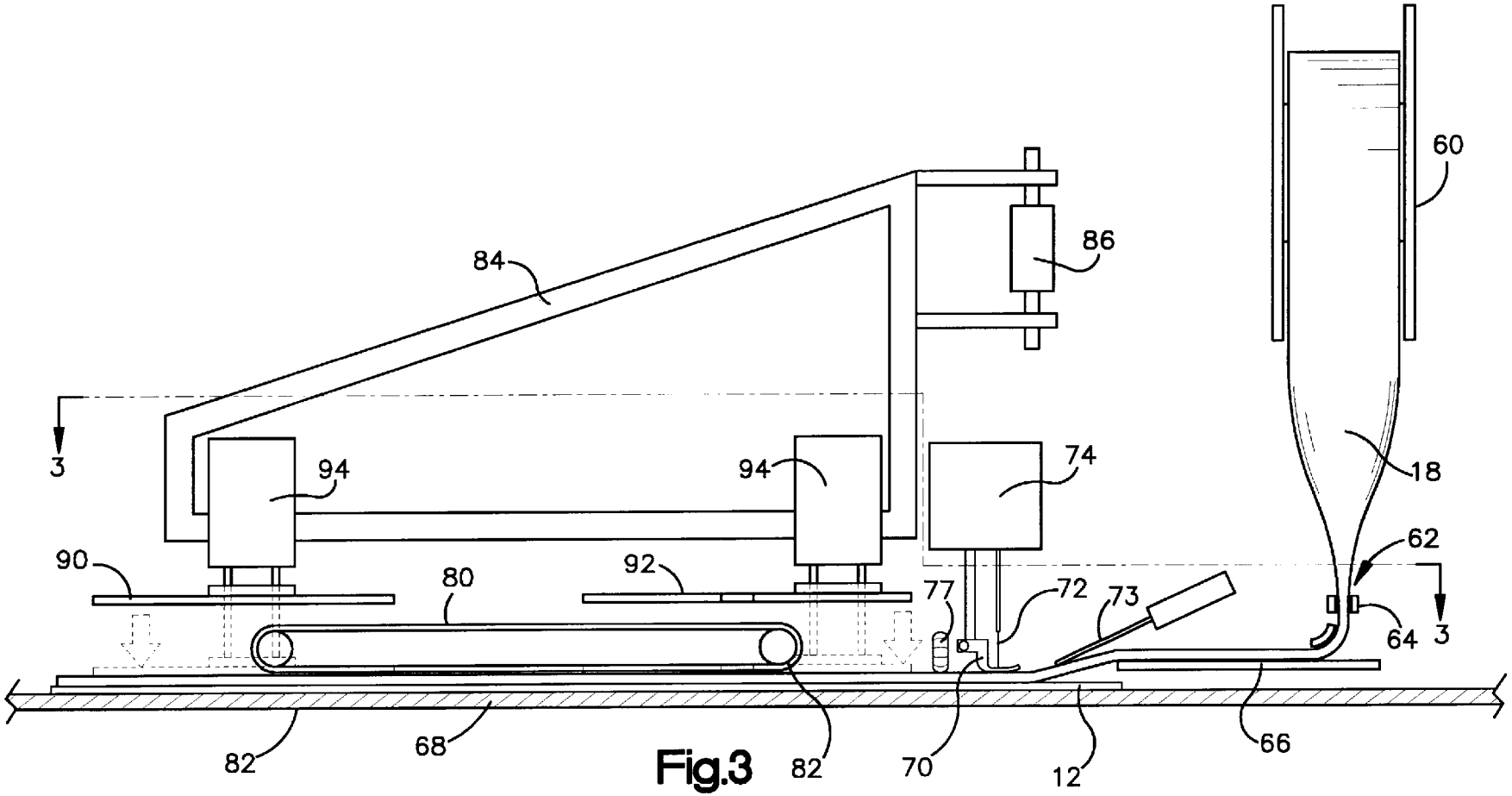
FIG. 3 is a schematic elevation of a gusset manufacturing machine of the present invention.
Figure 4:
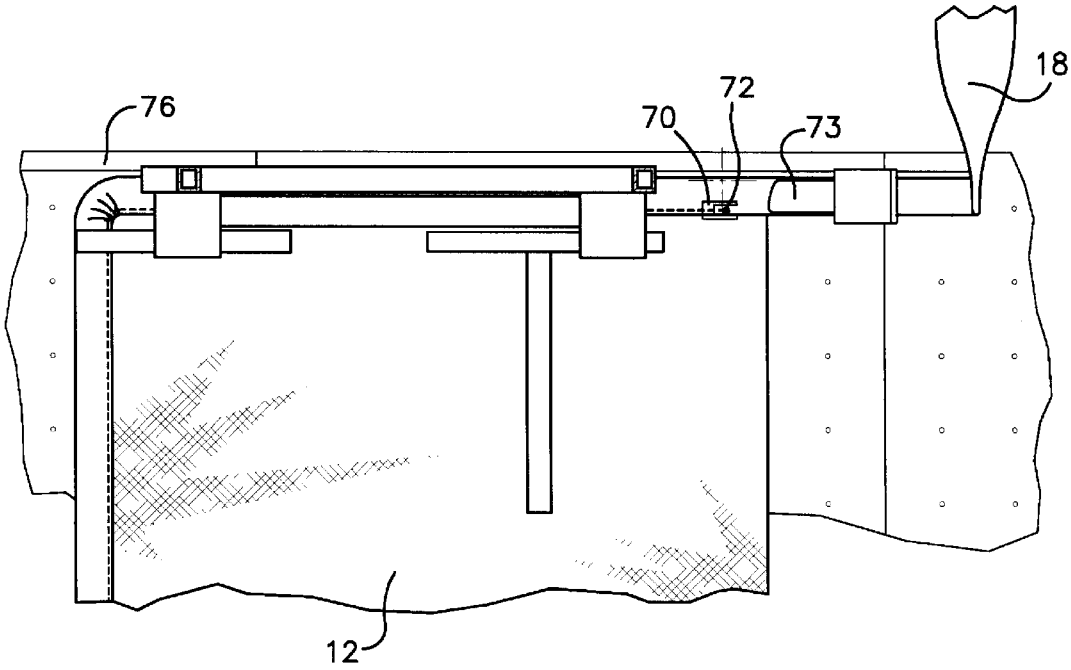
FIGS. 4, 5 and 6 are top views of a portion of a gusset manufacturing machine of the present invention.
Figure 5:
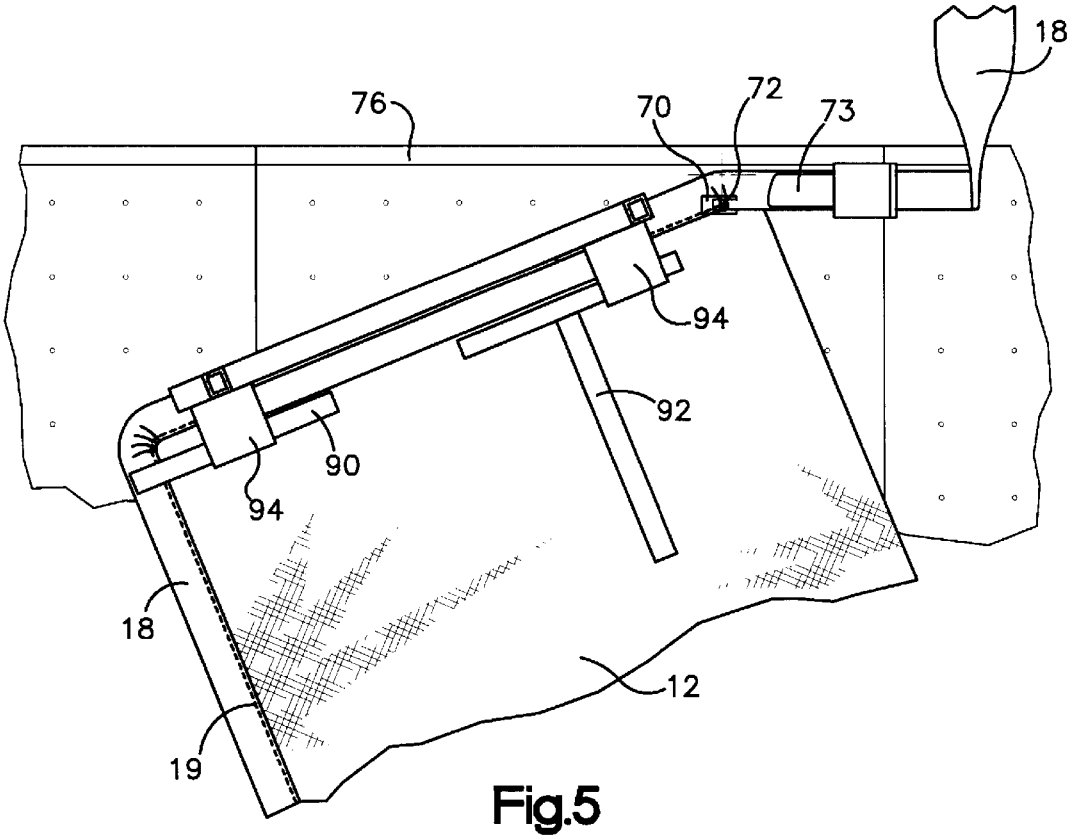
Figure 6:
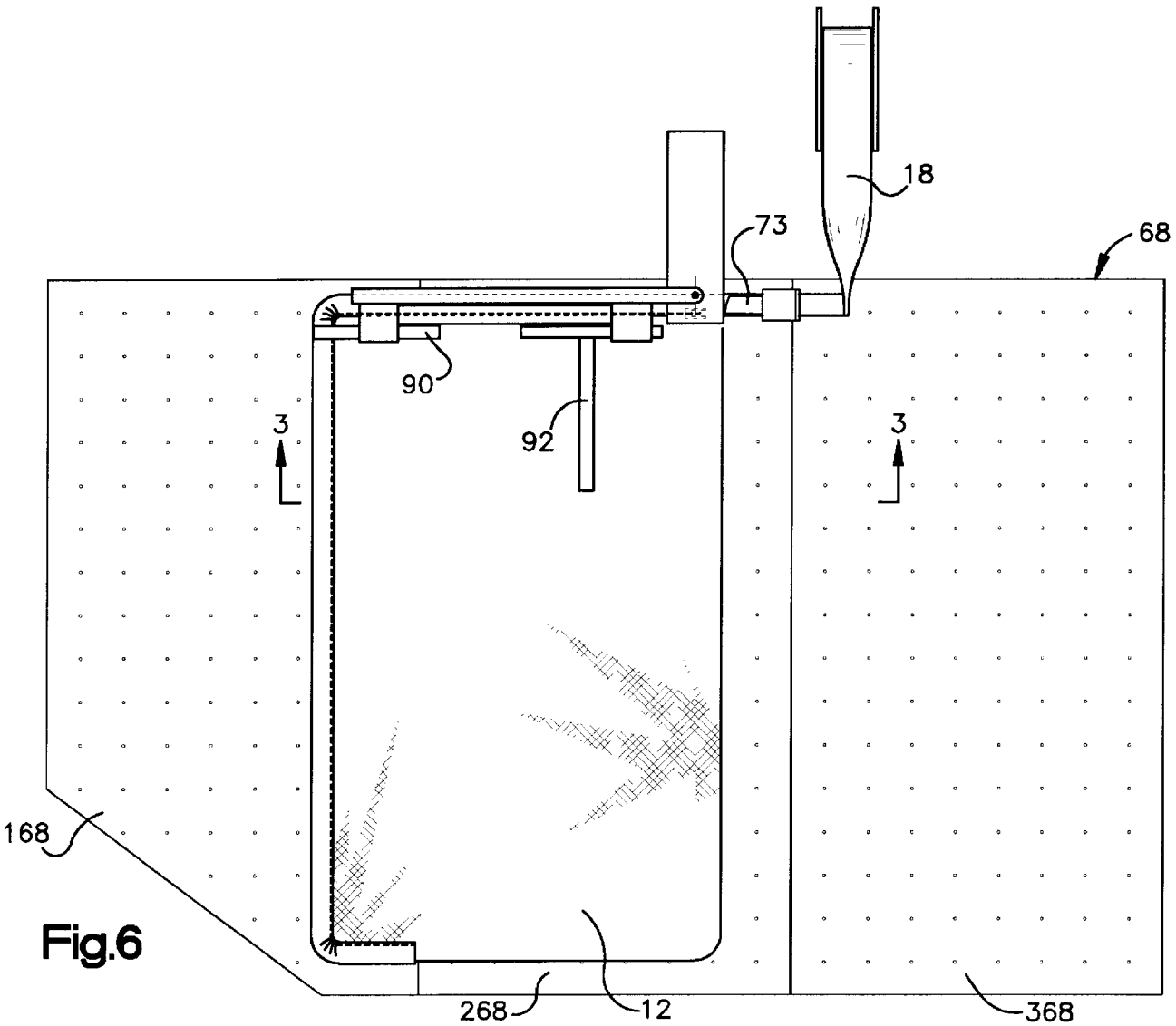
Figure 7:
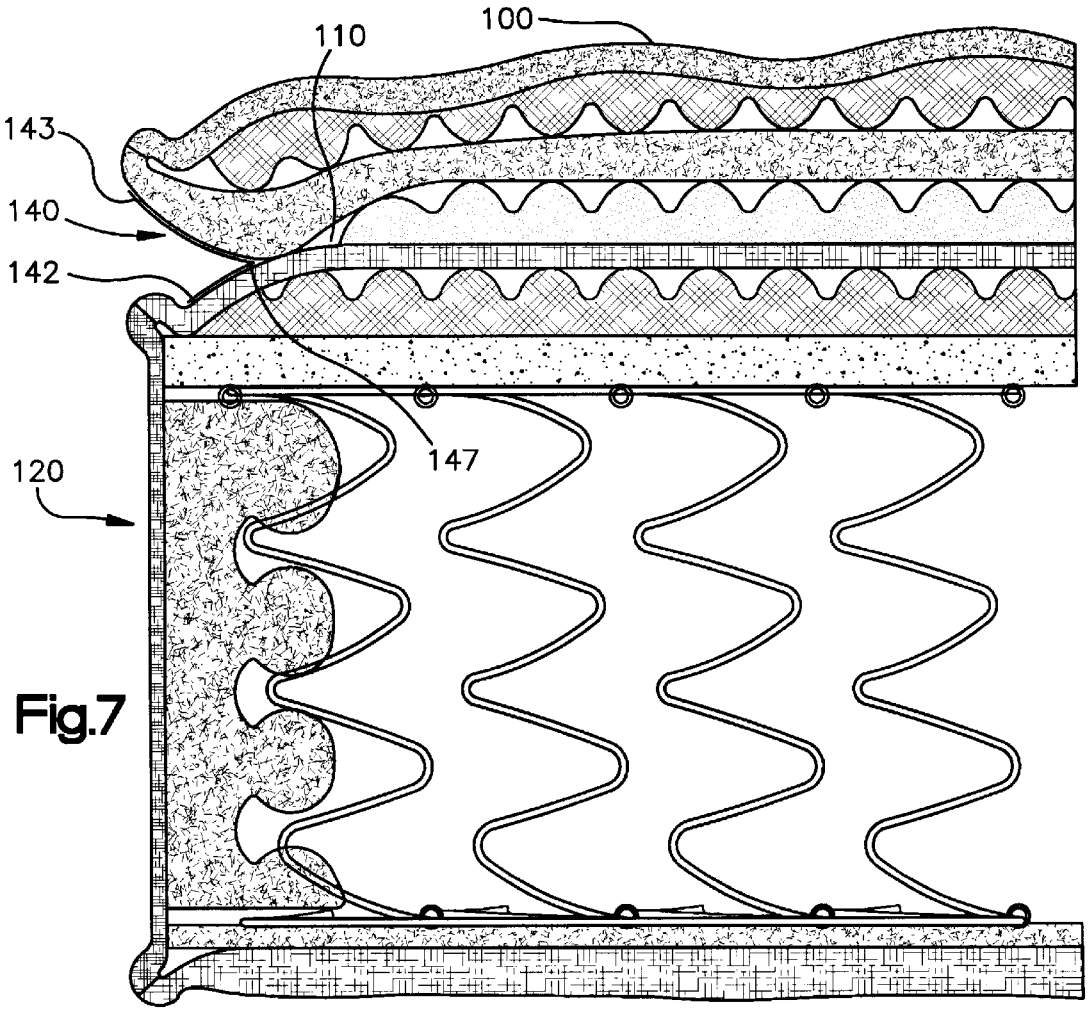
FIGS. 7 and 8 are elevation and plan views, respectively, of a prior art gusset attachment of a pad or pillowtop.
Figure 8:
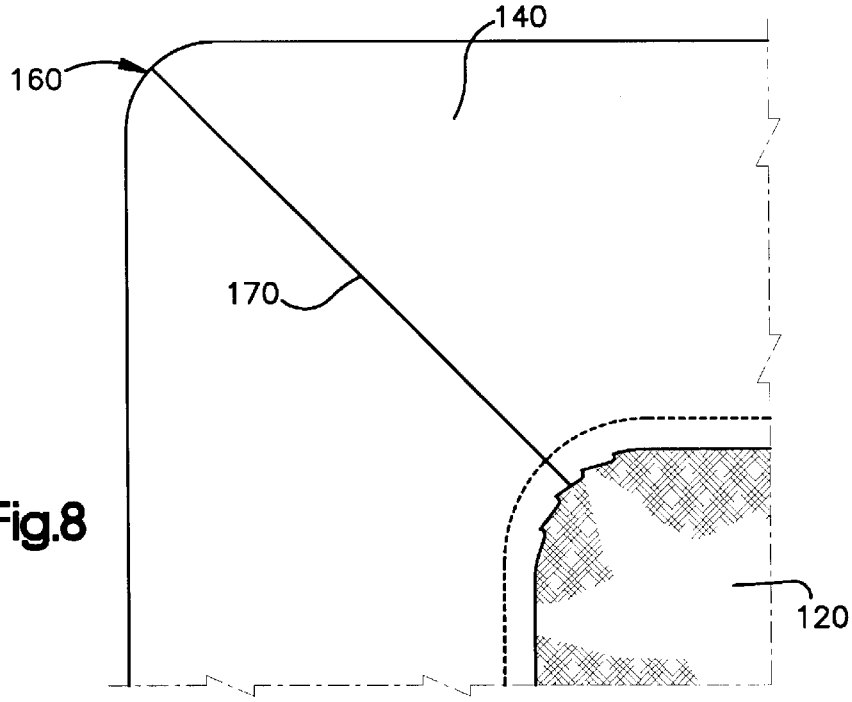

After folding, the gusset material is guided onto a horizontal staging platform 66, which is elevated slightly above a sewing table 68. In the case of mattress manufacture, a panel 12 is positioned flat upon the sewing table 68 and under a foot 70 and sewing needle 72 of an automatic sewing machine 74. The folded gusset 18 is guided under the foot 70 and needle 72, and just prior to that under a pleating blade 73. As shown in FIG. 6, the edge of the panel 12 is placed against a guide wall 76 near an edge of the sewing table 68. The aligned edges 21 and 22 of the gusset 18 are also guided against wall 76, over panel 12 and aligned with the panel edge also against wall 76. A drive belt 80, mounted on drive rollers 82, maintains the gusset and panel edges in alignment against guide wall 76, and advances the panel and gusset through the sewing station, sliding over table 68. An additional material alignment device 77 may be provided proximate to wall 76, in the form of a bi-directional wheel which is driven as needed to maintain alignment of the material edge against wall 76. As shown in FIG. 3, the line of stitches 19 is made proximate to the fold 20 in the gusset 18. However, the invention is not limited to this particular gusset construction, and is readily applicable to sewn attachment at other areas across the width of the gusset material. Furthermore, the gusset does not have to be in a folded condition when attached to an adjacent layer such as panel 12. As further described herein, the sewing table 68 is an air table with plural air holes 69 through which an air flow of appropriate volume and velocity is forced to facilitate sliding motion of the panel 12 over the surface of the table, as guided by the described machine components.

As a corner of the panel 12 arrives at the sewing needle 72, clamps 90 and 92 are lowered by actuators 94 to compress the panel 12 against table 68. Clamps 90 and 92 are mounted upon a hinge-mounted arm 84, controlled by rotational actuator 86 to rotate the arm 84 and clamps 90, 92, in this case ninety degrees, although other degrees or ranges of movement are within the scope of the invention. The panel 12 is thus turned ninety degrees relative to the guide wall 76 and about the sewing needle 72. As this turning motion is taking place, the pleating blade 73 is actuated to create the radial series of pleats 32 along the inside edge or fold 20 of the gusset 18. Preferably, the pleating blade 73 is actuated independent of the drive belt 80. This enables selective design of the ruffle pattern, e.g., number of pleats, relative to the rate at which the gusset material is drawn from the spool and sewn to the panel. In practice, the drive belt 80 is driven (by rollers 82) at a much higher rate as the gusset is sewn along a straight line, as compared to the corners at which the combined operations of the panel turning and the ruffle formation (by extension and retraction of the pleating blade 73) are performed.

The machine control can be configured to operate according to known dimensions of the panel, or to calculate the panel perimeter upon completion of the gusset attachment. In one type of set-up, the panel is positioned with a midpoint of one side at the sewing needle 72. The gusset 18 is sewn along the panel edge to the first corner, which is either optically detected or known from a pre-programmed dimension. The ruffled corner is formed and sewn, and the gusset sewn along the next panel edge. When the panel edge opposite to the starting edge is reached, the distance of the first leg sewn is doubled to complete that side. The next corner is formed, and the gusset sewn to the other opposite side. Following formation of the last ruffled corner, the gusset is sewn to the midpoint starting position, after which the ends of the gusset are sewn together.

To facilitate turning of the entire panel without wrinkling by the rotational translation of the hinge mounted clamps 90, 92, a constant flow of air is forced through holes 69 in the sewing table 68. The pressure and velocity of the air flow is adjusted according to the porosity of the panel material. The air flow is preferably adjusted to an optimal pressure/velocity setting which minimizes sliding friction of the panel upon the sewing table, so that the entire panel is easily re-oriented through the ninety degree turns by the clamps 90, 92 as the gusset is sewn about the perimeter. To control differential air pressure and flow rates caused by the panel covering a substantial number of the holes 69 of the table, multiple plenums or chambers are preferably provided under the table through which a compressed air supply is ducted. For example, as shown in FIG. 6, the table 68 is divided into three chambers 168, 268 and 368 which are each supplied with compressed or pressurized air supply. By this arrangement, in that state where the panel 12 is covering substantially all of the holes of a chamber, the air pressure in the adjacent chambers is not affected, and therefore does not disrupt the sewing operation.

The invention thus provides a novel gusset construction, and an automated method and machinery for rapid construction and attachment of the gusset to a supporting panel or adjoining layer of material. As applied to pillowtop mattress production, the invention greatly facilitates the previously tedious and laborious task of gusset subassembly and attachment to the mattress panel. Panels can be pre-manufactured with the ruffled gusset in a fraction of the time of prior art methods, ready for assembly over the mattress innerspring, followed by attachment of the pillowtop. Although described in this context, the invention is applicable to any type of sewn gusset construction, wherein an intermediate layer or piece of material is sewn attached to two or more pieces or layers, and wherein the gusset is curved or contoured to change direction, at which point one or pleats are formed so that the gusset lies generally flat in a pressed condition.

What is claimed as the invention is:

1. A pleated attachment gusset for attachment of a first generally planar panel to a second generally planar panel positioned parallel to the first panel, the pleasted attachment gusset comprising:

a piece of gusset material having one or more pleats formed by pleat folds at a first edge of the gusset material, the pleat folds being attached at points proximate to the first edge of the gusset material and to a first panel, whereby a direction of the gusset material is altered about the pleats according to a number and size of the one or more pleats, and a second edge of the gusset material attached to the second panel.

2. The attachment gusset of claim 1 wherein the one or more pleats extend partially across a width of the gusset material.

3. The attachment gusset of claim 1 comprising a plurality of pleats forming a ruffled corner whereby the direction of the gusset material is altered approximately ninety degrees.

4. The attachment gusset of claim 1 wherein the gusset material is continuous about a perimeter of the first panel.

5. The attachment gusset of claim 1 having a plurality of pleats evenly spaced.

6. The attachment gusset of claim 1 wherein the one or more pleats do not extend across an entire width of the gusset material.

7. The attachment gusset of claim 1 in combination with a panel of a mattress.

8. The attachment gusset of claim 1 in combination with a mattress pillowtop.

9. The attachment gusset of claim 1 wherein the gusset material is made of mattress upholstery material.

10. The attachment gusset of claim 1 wherein the gusset material is folded along a length.

11. A mattress having a panel on one side of a mattress innerspring, a gusset attached generally about a perimeter of the panel, the gusset made of a piece of material folded about a length dimension, wherein the gusset is attached to the panel proximate to a fold in the gusset material, a first edge of the gusset opposite the fold attached to a perimeter of the panel, a second edge of the gusset adapted for attachment to another panel, and corners of the gusset having one or more pleats forming a ruffled gusset corner.

12. The mattress of claim 11 wherein the second edge of the gusset is attached to a perimeter of a mattress pillowtop.

13. The mattress of claim 11 wherein the each of the corners of the gusset have a plurality of generally evenly spaced pleats.

14. The mattress of claim 11 wherein the one or more pleats at the corners of the gusset are sewn to the first panel.

15. The mattress of claim 11 wherein the one or more pleats at the corners of the gusset are generally evenly spaced.

16. The mattress of claim 11 wherein the gusset material is made of mattress upholstery material.

17. The mattress of claim 11 wherein the one or more pleats extend partially across a width of the gusset material.

18. The mattress of claim 11 wherein the first edge of the gusset is attached to the mattress panel by a tape edge.

19. The mattress of claim 11 wherein the second edge of the gusset is attached to a second panel by a tape edge.

20. The mattress of claim 11 wherein the gusset is attached to the panel at points spaced from a perimeter of the panel.

21. A pillowtop mattress having a mattress innerspring defining two parallel and spaced-apart support surfaces and an orthogonal sides between the support surfaces, the innerspring being covered by a panel over each support surface and a border over the orthogonal sides, perimeter edges of the panels being joined to edges of the border to encapsulate the innerspring in upholstery material, a gusset sewn about a perimeter of at least one panel, the gusset being in the form of a continuous strip of material which is folded along a length dimension and sewn proximate to the fold to the panel so that first and second edges of the gusset opposite the fold are generally aligned with a perimeter of the panel, the gusset having one or more pleats at corners of the panel, the pleats forming a ruffled gusset corner whereby the first edge of the gusset opposite the fold is configured for attachment to the perimeter of the panel, and the second edge of the gusset configured for attachment to an overlying pillowtop panel, whereby the gusset attaches a pillowtop encapsulated by the pillowtop panel to the panel covering the mattress innerspring to form a pillowtop mattress.

22. The pillowtop mattress of claim 21 wherein the gusset is made of mattress upholstery material.

23. The pillowtop mattress of claim 21 wherein the gusset is folded in half along a length dimension.

24. The pillowtop mattress of claim 21 wherein each corner of the gusset at corners of the perimeter of the mattress has four or more pleats which form a ruffled gusset corner.

25. The pillowtop mattress of claim 21 wherein the ruffled gusset corners lie substantially flat when in a pressed condition.

26. The pillowtop mattress of claim 21 wherein the gusset is sewn along two different lines to the panel covering the mattress innerspring, and sewn along one line to a perimeter of the pillowtop panel.

27. The pillowtop mattress of claim 21 further comprising a tape edge in combination with the second edge of the gusset and the pillowtop panel.

28. The pillowtop mattress of claim 21 wherein the pillowtop panel is a border of a pillowtop.

29. The pillowtop mattress of claim 21 wherein the pleats of the ruffled gusset corners are overlapping.

30. The pillowtop mattress of claim 21 wherein edges of the gusset are sewn to the respective panels with a tape edge.

* * * * *